United States Patent [19]

Marshall

[11] Patent Number: 4,523,782

[45] Date of Patent: Jun. 18, 1985

[54] LOAD-ABSORBING MOUNT FOR ELECTROMAGNETS

[76] Inventor: Glenn E. Marshall, 346 County Rd. 681, Sullivan, Ohio 44880

[21] Appl. No.: 472,289

[22] Filed: Mar. 7, 1983

[51] Int. Cl.[3] ..... B66C 1/04

[52] U.S. Cl. ..... 294/65.5

[58] Field of Search ..... 294/65.5, 86 R; 267/174, 178; 248/54, 55, 49, 361

[56] References Cited

U.S. PATENT DOCUMENTS

| | | | |
|---|---|---|---|
| 2,946,616 | 7/1960 | Carter | 294/65.5 |
| 3,299,628 | 1/1967 | Chisler | 294/65.5 |
| 3,471,193 | 10/1969 | Hayes | 294/65.5 |
| 4,044,894 | 8/1977 | McDonald et al. | 294/65.5 |

OTHER PUBLICATIONS

Bux-Schrader Co. Advertisement.

Steel Handling, SEC.

Steel Handling, SEC, Mar. 1975.

*Primary Examiner*—James B. Marbert

*Attorney, Agent, or Firm*—Porter & Bremer Co.

[57] ABSTRACT

A load-absorbing mount for electromagnets includes a connecting member to which a plurality of chains are connected at one end, the chains being connected at the other end to the electromagnet. A lifting device such as a crane is connected to a load-carrying member, and a spring is disposed intermediate the connecting member and the load-carrying member. In a preferred embodiment, the spring is arranged relative to the connecting member and the load-carrying member such that the spring is always under compression. Due to the flexible nature of the spring, loads imparted to the crane by the electromagnet are cushioned under all operating conditions.

12 Claims, 5 Drawing Figures

LOAD-ABSORBING MOUNT FOR ELECTROMAGNETS

BACKGROUND OF THE INVENTION

1. Field of the Invention

The present invention relates to electromagnets and, more particularly, to an attachment device for connecting an electromagnet to a lifting device such as a crane, whereby sudden loads imparted to the crane by the electromagnet are cushioned.

2. Description of the Prior Art

A typical electromagnet includes a disc-like element having a work-engaging face and a non-work-engaging face oppositely disposed. A plurality of chains or other force-transmitting members are connected at one end to the non-work-engaging face. The chains are connected at the other end to a ring, a clevis, or other connecting member. In turn, a lifting device such as a crane having a hook can be connected to the connecting member. Thereafter, upon raising or lowering the crane, the electromagnet can be moved from place to place.

The type of electromagnet attachment referred to is mechanically simple and reliable, but it has failed to address certain problems. One of these problems relates to the use of electromagnets with hydraulic cranes. A hydraulic crane is a self-propelled device employing a plurality of interconnected booms. Because the electromagnet is directly connected to the outermost boom of the crane, structural problems can develop when sudden loads are imparted from the electromagnet to the crane. These loads can be very severe and can lead to stress cracks, broken pins and bushings, and other maintainence problems in the crane not always identified with the use of electromagnets. It is believed that a resilient attachment between the crane and the electromagnet would solve many of these problems.

Unfortunately, known resilient attachments for connecting electromagnets to cranes have not been adequate for properly absorbing loads imparted to the crane by the electromagnet. For example, one known resilient support for electromagnets employs a ring connected to a plurality of chains, the chains being connected at their other end to the non-work-engaging face of the electromagnet. A tube extends downwardly from the ring toward the upper surface of the non-work-engaging face. A spring disposed within the tube constantly biases the ring upwardly, away from the non-work-engaging face. By this construction, the chains are always maintained in a taut condition. Because the chains are in a taut condition, the ring is maintained in a fixed position relative to the electromagnet. This makes it easier for a crane or other lifting device to be connected to the ring. Unfortunately, it does nothing to absorb loads imparted to the crane upon lifting the electromagnet and moving it from place to place.

Another known attachment for connecting electromagnets to cranes is adapted especially for use with coils of strip steel. The electromagnet includes an opening at its center through which a vertically oriented plunger extends. The lower, central portion of the electromagnet includes a plurality of pivotally mounted fingers. The plunger is disposed at the center of the fingers and is configured such that, upon attaching a lifting device to the plunger and lifting the plunger upwardly, the fingers are urged outwardly. By positioning the fingers and plunger within the center of a coil of strip steel lying on its side, and by lifting the plunger with a crane, the fingers will be urged into tight contact with the inner diameter of the coil. The contact between the fingers and the coil, combined with the attractive force generated by the electromagnet, will be sufficient to enable the coil to be lifted.

A spring is provided in order to cause the plunger to be moved downwardly upon removing force from the crane. The spring is disposed intermediate the underside of a portion of the electromagnet and the upper surface of a portion of the plunger. Although the spring arguably cushions loads imparted to the crane during initial phases of a lifting operation, no resilient support is provided once the fingers have engaged the inner diameter of the coil. In effect, the spring provides no load-absorbing capabilities under virtually all operating conditions.

SUMMARY OF THE INVENTION

The present invention provides a new and improved mount for connecting a crane or other lifting device to an electromagnet wherein loads are cushioned under all operating conditions. The mount is usable with electromagnets having a work-engaging face and a non-work-engaging face oppositely disposed. It is expected that the mount will include a plurality of force-transmitting members, each force-transmitting member being attached at one end to the non-work-engaging face of the electromagnet. In a preferred embodiment of the invention, the force-transmitting members are in the form of chains.

A connecting member is provided to which the force-transmitting members are connected at their other ends. The invention also includes a load-carrying member to which the lifting device is connected, and a spring disposed intermediate the connecting member and the load-carrying member. The spring absorbs loads imparted to the lifting device by the electromagnet under all operating conditions.

The connecting member and the load-carrying member are arranged relative to each other such that the spring is under compression while the electromagnet is being lifted. In a preferred embodiment, the connecting member is in the form of a plate having attachment points for receiving the ends of the force-transmitting members. The load-carrying member is in the form of an elongate pin having means for connection to the lifting device at one end and a plate secured at the other end. The spring is disposed about the pin and in engagement with both of the plates. In this position, the spring biases the plates apart.

When the electromagnet is lifted initially, and during all operations thereafter, forces transmitted to the connecting member through the chains are absorbed resiliently by the spring. Use of the invention enables stress in the crane to be reduced, operating shock to be absorbed, and the ride of the electromagnet to be smoothed during travel. A direct benefit resulting from use of the invention is that downtime of the crane is minimized and maintainence expense is conserved.

The foregoing and other features and advantages, and a fuller understanding of the invention, may be had by referring to the following description and claims, taken in conjunction with the accompanying drawings.

DESCRIPTION OF THE PREFERRED EMBODIMENT

Figure 1:
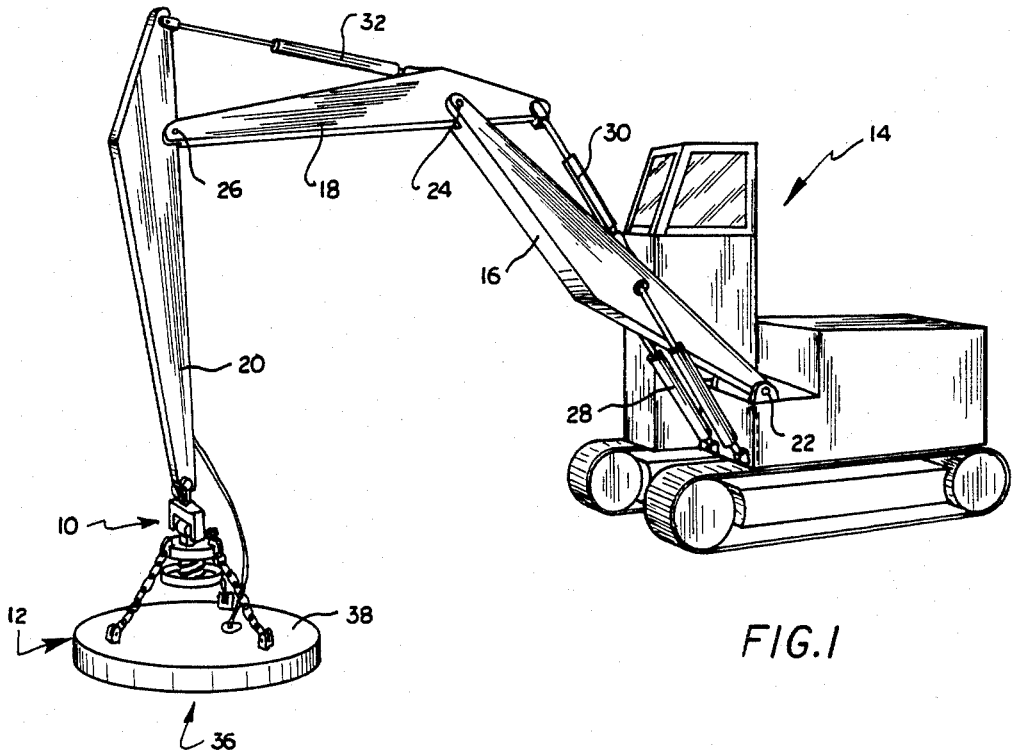
FIG. 1 is a perspective view of a crane and an electromagnet in which the electromagnet is attached to the crane by a load-absorbing mount according to the invention.

Referring to FIG. 1, a load-absorbing mount 10 according to the invention is illustrated. The mount 10 provides an attachment for connecting an electromagnet 12 to a crane 14. The crane 14 includes three rigid booms 16, 18, 20 pivotally connected to the main body of the crane and to each other by pins indicated at 22, 24, 26. The booms 16, 18, 20 are connected to each other and are actuated by a plurality of hydraulic cylinders 28, 30, 32. It will be appreciated from the foregoing description that the boom 20 can be manipulated to control precisely where the electromagnet 12 will be moved but, due to the rigid interconnection of the booms 16, 18, 20, any sudden loads imparted to the boom 20 possibly could cause failure of the other booms, the hydraulic cylinders, the pins, or other components of the crane 14.

The mount 10 provides a technique for avoiding the imposition of sudden loads on the boom 20 and, hence, the remainder of the crane 14. Referring particularly to FIGS. 2–5, the mount 10 is connected to the electromagnet 12 by means of a plurality of force-transmitting members 34. In the embodiment illustrated, the force-transmitting members 34 are in the form of chains. The electromagnet 12 includes a work-engaging face 36 and a non-work-engaging face 38. The chains 34 are connected to the face 38 by means of clevises 40 and pins 42. The clevises 40 are positioned equidistantly about the periphery of the face 38. The electromagnet 12 also includes an electrical cable 44 for energizing the electromagnet 12 as known in the art.

The other ends of the chains 34 are connected to the mount 10 by means of clevises 46 and pins 48. The mount 10 includes a connecting member 50 to which the chains 34 are attached. The connecting member 50 is in the form of a plate 52 having a plurality of attachment points, or bosses 54, rigidly secured about the periphery of the plate 52. The bosses 54 receive the pins 48. The plate 52 includes a downwardly extending flange 56 disposed near its periphery for providing additional support for the bosses 54. The plate 52 also includes an opening 58 located near its center, as well as a pair of bars 60 secured atop the plate 52 by means of bolted fasteners 62. The bars 60 partially overlie the opening 58.

The mount 10 also includes a load-carrying member 64 to which the boom 20 is connected. The load-carrying member 64 is in the form of an elongate, wide pin 66 having a plate 68 secured at one end. A flange 70 extends upwardly from the outer periphery of the plate 68. The other end of the pin 66 includes a cylindrical portion 72. A first clevis 74 is connected to the cylindrical portion 72 by means of a pin 76. A second clevis 78 is connected to the first clevis 74 by means of a pin 80. The upper end of the second clevis 78 includes an enlarged, ring-like portion 82 to enable the second clevis 78 to be connected to the boom 20. Together, the clevises 74, 78, the pins 76, 80, and the ring-like portion 82 define a means for connecting the pin 66 to the crane 14.

Figure 2:
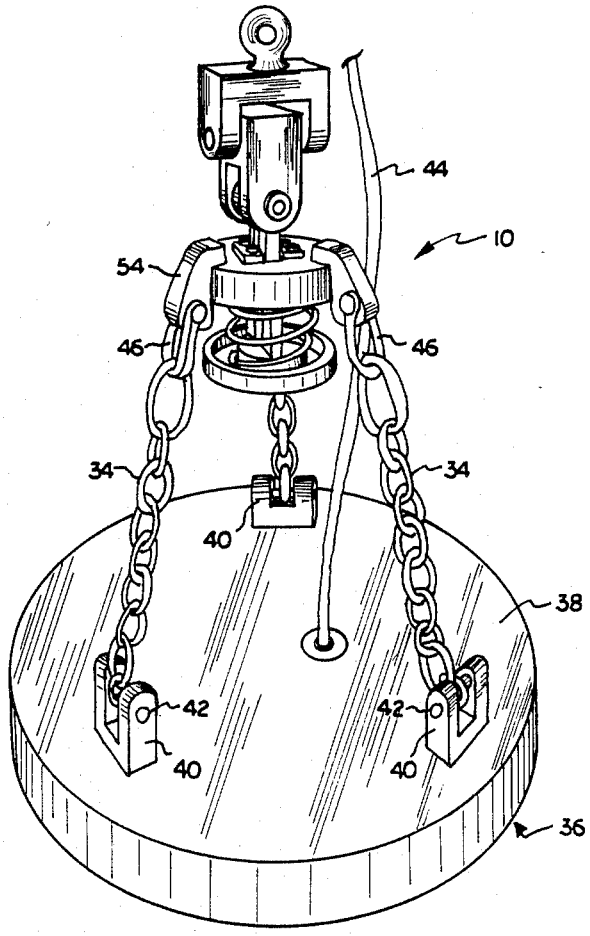
FIG. 2 is an enlarged view of a portion of FIG. 1 showing details of the electromagnet and its mount.
Figure 3:
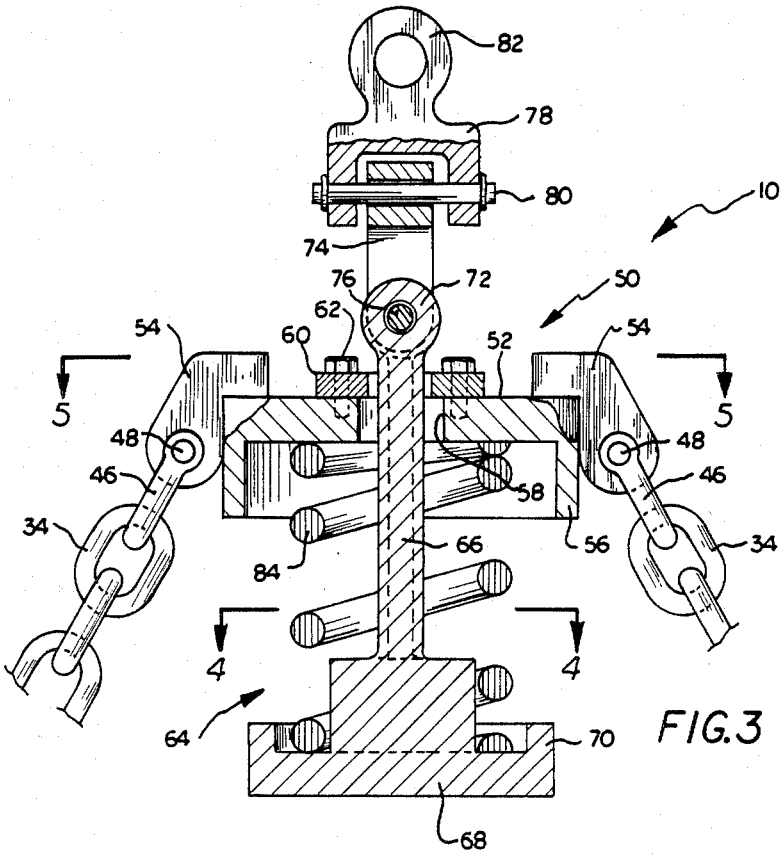
FIG. 3 is a side-elevational view, partly in section, of the load-absorbing mount according to the invention.
Figure 4:
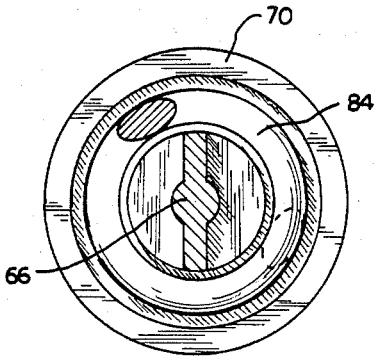
FIG. 4 is a cross-sectional view taken along line 4—4, of FIG. 3.
Figure 5:
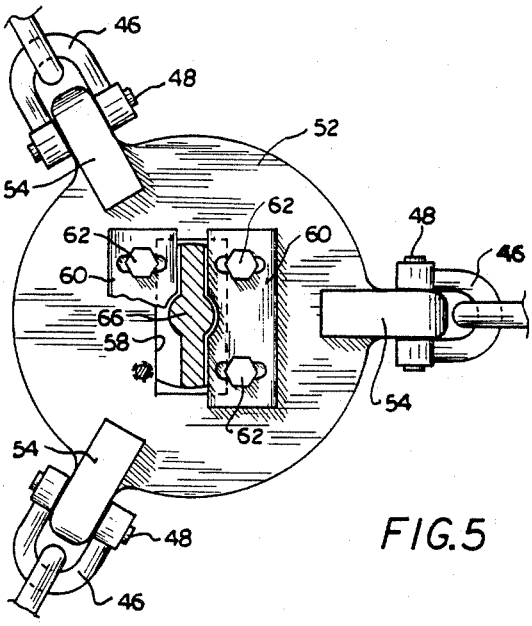
FIG. 5 is a view taken along line 5—5 of FIG. 3.

A helical spring 84 is disposed intermediate the connecting member 50 and the load-carrying member 64 such that loads imparted to the crane 14 by the electromagnet 12 will be absorbed effectively under all operating conditions. Referring particularly to FIGS. 2 and 3, the spring 84 is fitted about the pin 66 and in engagement with the underside of the plate 52 and with the upper surface of the plate 68. Referring particularly to FIG. 5, it will be seen that the bars 60 permit the mount 10 to be assembled and disassembled while, at the same time, preventing excessive lateral displacement of the pin 66. The bars 60 can be adjusted to engage the pin 66 as tightly as may be desired.

In operation, after the boom 20 has been connected to the mount 10 by attachment to the ring-like portion 82, the electromagnet 12 can be lifted as rapidly as desired. Regardless of whatever forces may be applied to the chains 34, the plate 50 will be compressed against the spring 84. In turn, loads applied to the plate 68 and the pin 66 will be cushioned. Because these loads will be cushioned, loads applied to the boom 20 will be lessened. By use of the mount 10, virtually all stress cracks, broken pins and bushings, and other related maintainence problems can be eliminated. As will be apparent from an examination of the various FIGURES, the mount 10 according to the invention is exceedingly simple in construction, inexpensive to manufacture, easy to assemble and disassemble, and reliable in operation.

Although the invention has been described with a certain degree of particularity, it will be appreciated that the present disclosure of the preferred embodiment has been made only by way of example, and that numerous changes in the details of design and construction may be resorted to without departing from the true spirit and scope of the invention as hereinafter claimed. It intended that the patent shall cover, by suitable expression in the appended claims, whatever degree of patentable novelty exists in the invention disclosed.

What is claimed is:

1. A load-absorbing mount for connecting a crane or other lifting device to an electromagnet having a work-engaging face and a non-work-engaging face oppositely disposed, comprising:

a plurality of force-transmitting members, each force-transmitting member being connected at one end to the non-work-engaging face of the electromagnet;

a connecting member to which each force-transmitting member is connected at its other end;

a load-carrying member to which the lifting device is connected;

adjustment means disposed intermediate the connecting member and the load-carrying member, the adjustment means movable relative to the connecting member and the load-carrying member in order to control the spacing between the connecting member and the load-carrying member; and a spring disposed intermediate the connecting member and the load-carrying member, the spring serving to absorb loads imparted to the lifting device by the electromagnet under all operating conditions.

2. The mount of claim 1, wherein the connecting member and the load-carrying member are arranged relative to each other such that the spring is under compression while the electromagnet is being lifted.

3. The mount of claim 2, wherein the connecting member includes an opening, the load-carrying member extends through the opening, and the spring engages the underside of a portion of the connecting member and the upper surface of a portion of the load-carrying member.

4. The mount of claim 3, wherein:

the connecting member is in the form of a first plate havine means for receiving the force-transmitting members, the means for receiving the force-transmitting members being located about the periphery of the first plate; and the load-carrying member is in the form of an elongate pin having means for connection to the lifting device at one end and a second plate at the other end, the spring being disposed about the pin and in engagement with the first and second plates, the spring serving to bias the first and second plates apart.

5. The mount of claim 4, wherein the first plate includes a downwardly extending flange for providing additional support for the force-transmitting members.

6. The mount of claim 4, wherein the means for connecting the pin to the lifting device is in the form of a universal joint, the universal joint including a first clevis connected to the pin and a second clevis connected to the first clevis, the lifting device being connected to the second clevis.

7. The mount of claim 1, wherein the force-transmitting means is in the form of chains.

8. The mount of claim 1, wherein the spring is a helical spring.

9. The mount of claim 1, wherein the adjustment means is in the form of bars secured to the connecting member by fasteners, the fasteners permitting the bars to be moved relative to the connecting member.

10. A load-absorbing mount for connecting a crane or other lifting device to an electromagnet having a work-engaging face and a non-work-engaging face oppositely disposed, comprising:

a plurality of chains, each chain attached at one end to the non-work-engaging face of the electromagnet;

a connecting member to which each chain is connected at its other end, the connecting member being in the form of a plate having attachment points for receiving the ends of the chains, the attachment points being located about the periphery of the plate, the plate also including a centrally disposed opening;

a load-carrying member to which the lifting device is connected, the load-carrying member being in the form of an elongate pin extending through the opening in the plate included as part of the connecting member, the pin including means for connecting the pin to the lifting device and also including a plate at the end of the pin opposite the means for connecting the pin to the lifting device, the plates being arranged relative to each other such that the plate included as part of the connecting means is disposed above the plate included as part of the pin;

a pair of bars secured to the connecting member and disposed on opposite sides of the pin, the bars partially overlying the opening included as part of the connecting member, the bars being adjustable relative to the pin in order to engage the pin as tightly as may be desired; and a spring disposed intermediate the two plates and about the pin, the spring being loaded in compression whenever the electromagnet is lifted by the lifting device.

11. The mount of claim 10, wherein the means for connecting the pin to the lifting device is in the form of a universal joint, the universal joint including a first clevis connected to the pin and a second clevis connected to the first clevis, the lifting device being connected to the second clevis.

12. The mount of claim 10, wherein the plate included as part of the connecting means includes a downwardly extending flange for providing additional support for the attachment points.

* * * * *